US005375507A

United States Patent [19]

Kladiwa et al.

[11] Patent Number: 5,375,507

[45] Date of Patent: Dec. 27, 1994

[54] HYDRAULIC CYLINDER

[75] Inventors: Wolfgang Kladiwa, Huglfing; Gerhard Huber, Frankenhofen; Klaus Stolle; Walter Kiefer, both of Altenstadt, all of Germany

[73] Assignee: Hoerbiger Ventilwerke Aktiengesellschaft, Vienna, Austria

[21] Appl. No.: 114,899

[22] Filed: Sep. 2, 1993

[30] Foreign Application Priority Data

Sep. 2, 1992 [AT] Austria ..... 1759/92

[51] Int. Cl.[5] ..... F01B 29/00

[52] U.S. Cl. ..... 92/128; 92/169.1; 29/888.06; 29/507; 29/523

[58] Field of Search ..... 92/164, 169.1, 171.1, 92/128; 29/888.06, 888.061, 507, 508, 516, 517, 522.1, 523

[56] References Cited

U.S. PATENT DOCUMENTS

| | | | |
|---|---|---|---|
| 1,658,553 | 2/1928 | Clements | 29/888.06 |
| 2,832,130 | 4/1958 | Harvey | 29/507 |
| 3,848,325 | 11/1974 | Bimba | 29/888.06 |
| 4,691,550 | 9/1987 | Dietzel | 29/516 |

FOREIGN PATENT DOCUMENTS

| | | | |
|---|---|---|---|
| 0945273 | 4/1949 | France | 92/169.1 |
| 0149659 | 9/1982 | Japan | 92/169.1 |
| 0157863 | 9/1982 | Japan | 92/169.1 |

*Primary Examiner*—Thomas E. Denion
*Attorney, Agent, or Firm*—Watson, Cole, Grindle & Watson

[57] ABSTRACT

To connect the cylinder pipe (1) of a hydraulic cylinder to a bottom (6), and a cover (8), the bottom (6) and cover (8) have groove-shaped recesses (16, 17), into which are pressed the ends (5, 7) of the cylinder pipe (1) under permanent deformation. To enable pressurization at high operating pressures, the region (25) of the inner end of the non-deformed cylinder pipe (1) is defined as a holding region (18, 19) and has a turned groove (26) which, in the deformed state of the cylinder pipe (1), reaches over the related inner edge (27) of the groove-shaped recesses (16, 17) with respect to the longitudinal stretch of the cylinder pipe (1).

13 Claims, 2 Drawing Sheets

Fig. 1
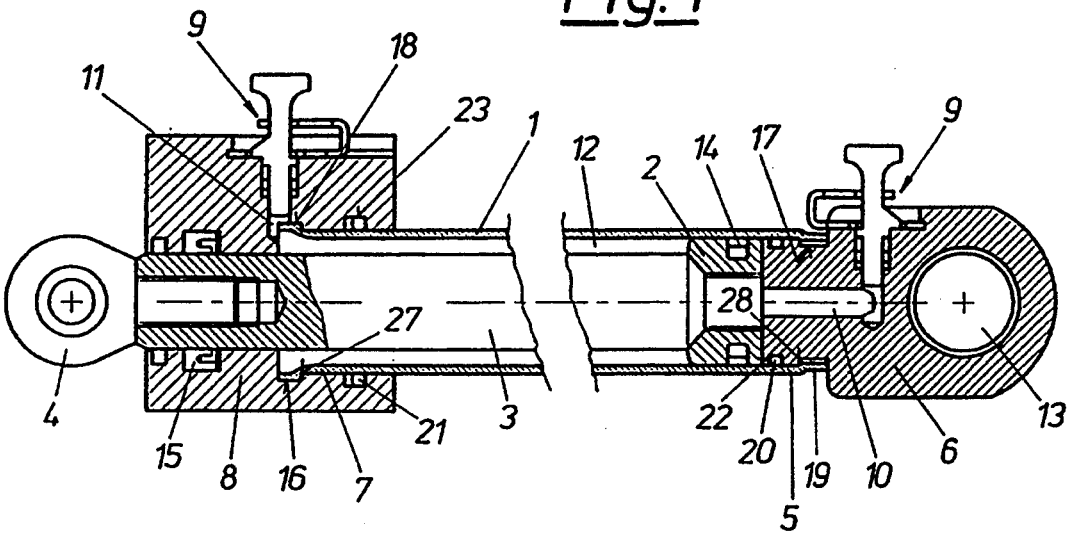
Fig. 2
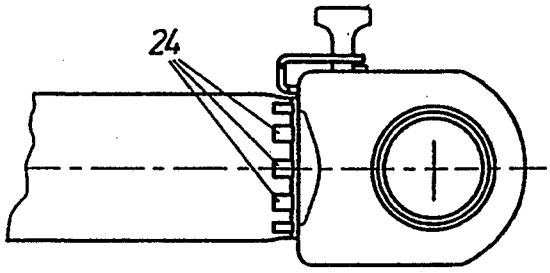
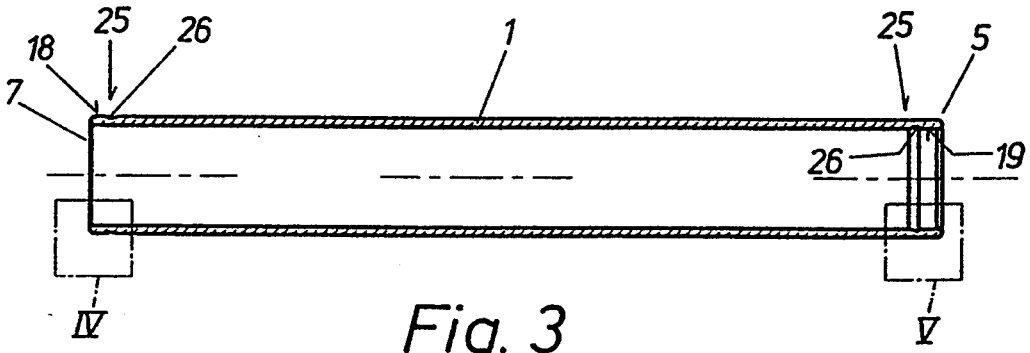
Fig. 3

Fig. 4
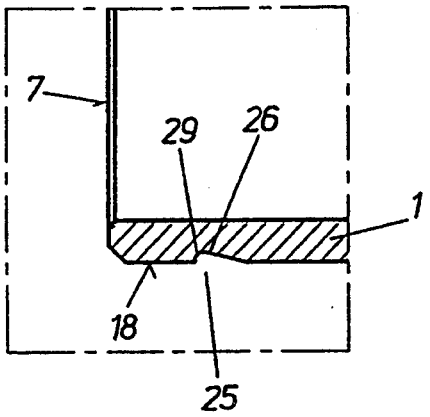
Fig. 5
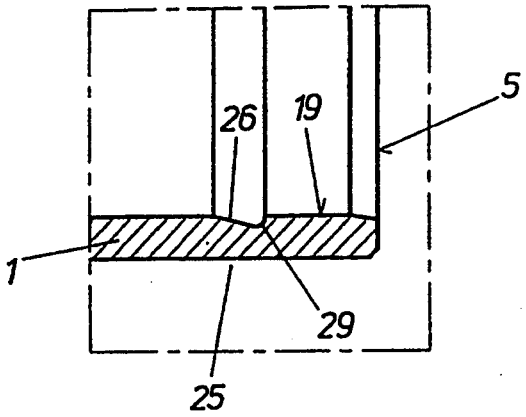
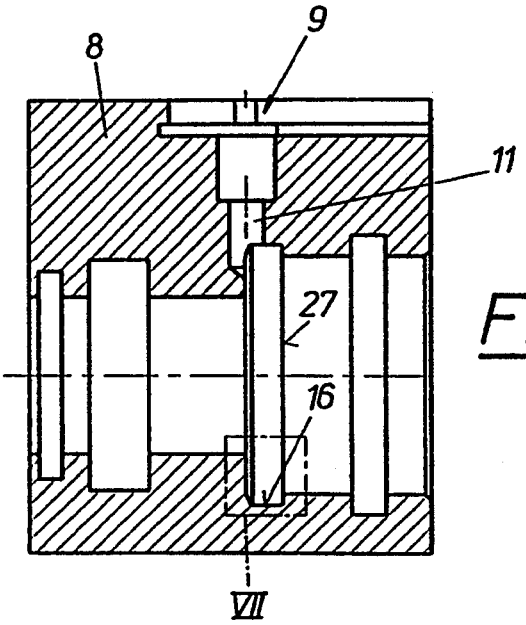
Fig. 6
Fig. 7
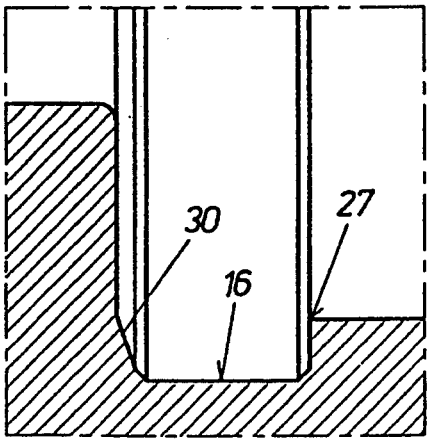

HYDRAULIC CYLINDER

FIELD OF THE INVENTION

The present invention relates to a hydraulic cylinder, with a cylinder pipe, whose one end is provided with a bottom and whose other end is provided with a cover. More particularly, the present invention relates to a connection between a cylinder pipe and a cover and bottom wherein the cover and bottom each has a groove-shaped recess into which a holding region of a respective end of the cylinder pipe is pressed and permanently deformed.

BACKGROUND OF THE INVENTION

Hydraulic cylinders of the aforementioned kind are known, for example, from the publications DE A1 22 38 211 and DE-A1 40 02 558 and are used in hydraulically operated or controlled devices, in particular, as working cylinders. This kind of connection between cylinder pipe and cover or bottom is simpler and less expensive to produce than such connections as screw thread, soldered or welded connections. This feature also offers advantages particularly with respect to mass produced articles.

In the case of these known hydraulic cylinders, the cylinder pipe is constricted by simply bending or beading and thus fits into a groove provided on the circumferential surface of the bottom or cover. This results in a particularly unreliable connection and is not very suitable for high working pressures. In the case of another known hydraulic cylinder, one side of the groove-shaped recess is designed in the shape of a truncated cone. The related end of the cylinder pipe is pressed into this recess through compressive deformation in such a manner that the material of the cylinder pipe forms an annular segment resting against the bottom in the region of the groove, and subsequently a conical segment resting against the conical surface. The drawback with this arrangement is that with higher stress the cylinder pipe can slip at least partially over the conical surface, resulting in at least a leak if not failure.

The object of the present invention is to improve a hydraulic cylinder of the aforementioned kind in such a manner that the aforementioned drawbacks of the known arrangements are avoided. More particularly, it is an object of the present invention to provide a more reliable connection between cylinder pipe and cover or bottom despite a simpler and less expensive production.

SUMMARY OF THE INVENTION

The above and other goals are achieved according to the present invention for a hydraulic cylinder of the aforementioned kind by providing a turned groove in the inner end of each holding region of the non-deformed cylinder pipe. The inner end is defined with respect to the longitudinal axis of the cylinder pipe. The turned groove, in the deformed state of the cylinder pipe, reaches over the related inner edge of the groove-shaped recess. The outer peripheral edge of the groove is designed angularly according to a preferred embodiment of the invention, with respect to the longitudinal axis of the cylinder pipe. During the compression operation the turned groove and its outer peripheral edge claw into the cover or bottom to some extent. More particularly, the turned groove and edge claw over the related inner edge of the groove-shaped recess. This results in a highly stressable, shape-locking connection, as a consequence of which the hydraulic cylinder can also be operated much more reliably at much higher operating pressures than the known hydraulic cylinders of the aforementioned kind. In this manner, even when the hydraulic cylinder is under high pressure, the cylinder pipe can no longer simply slip over the compressed parts.

In another embodiment of the invention, each end of the cylinder pipe can also have several holding regions with turned recesses and several related groove-shaped recesses. This design increases the maximum amount of stress that can be put on the connection.

According to an especially preferred embodiment of the invention the cylinder pipe is made of a relatively hard material, in particular, steel, and the bottom and/or cover is made of a relatively soft material, in particular, aluminum. Thus, the turned recess, and the outer edge, can claw itself into the softer material of the cover or bottom during the pushing or pressing-in operation. This feature further increases, in a simple manner, the reliability and seal of the connection and offers greater possibilities when choosing the materials.

Another preferred embodiment of the invention is characterized by the fact that the bottom and/or cover of the related end of the cylinder pipe is/are designed so as to overlap. The respective holding region is pushed from tile inside into the groove-shaped recess of the cover or bottom with its turned recess on the outside of the cylinder pipe. This feature increases the possibilities with respect to shape and thus application while retaining the targeted advantages.

BRIEF DESCRIPTION OF THE INVENTION

The invention is explained is detail with the aid of the embodiments shown in the drawings, wherein:

FIG. 1 is a longitudinal view of a hydraulic cylinder designed according to the invention;

FIG. 2 is an outer view of a section of the hydraulic cylinder according to FIG. 1;

FIG. 3 depicts a cylinder pipe for application in a hydraulic cylinder according to FIGS. 1 or 2 prior to compression with cover or bottom;

FIG. 4 depicts an enlarged detail IV from FIG. 3;

FIG. 5 depicts an enlarged detail V from FIG. 3;

FIG. 6 depicts a separate fragment of the cover of the hydraulic cylinder from FIG. 1 on an enlarged scale; and FIG. 7 depicts an exploded detail VII from FIG. 6.

DETAILED DESCRIPTION OF THE INVENTION

The illustrated hydraulic cylinder exhibits a cylinder pipe 1, in which a piston 2 is guided in the axial direction. The piston rod 3 of the piston projects outwardly and serves by means of a screwed-in piston rod eye 4 to operate the units that are not shown here. One side of the hydraulic cylinder is closed by means of a bottom 6 projecting into one end 5 of the cylinder pipe 1. The other end 7 is closed by means of a cover 8 reaching over the cylinder pipe 1. Both bottom 6 and cover 8 are provided with hydraulic attachments 9, which communicate via lines 10 and 11 with the interior 12 of the cylinder pipe 1 and serve to alternatingly pressurize the interior of the cylinder on either side of the piston with hydraulic medium in order to actuate the piston 2. For the sake of completeness, reference is made here also to a coupling bore 13 to attach the bottom 6 and thus the entire hydraulic cylinder to a housing frame or the like (not illustrated here). Reference is also made to a seal 14 to seal the piston 2 in the cylinder pipe 1 and a seal 15 to seal the piston rod 3 relative to the cover 8.

For the connection between cylinder pipe 1 and the cover 8 or bottom 6 there are groove-shaped recesses 16, 17 at the cover 8 and bottom 6, respectively. Into the recesses a holding region 18, 19 of the respective end 7, 5 of the cylinder pipe 1 is pushed and deformed permanently, a feature that results in a shape-locking, reliable connection even at high operating pressures. In addition, in the region of the ends 5, 7, sealing rings 20, 21 are also embedded into the related grooves 22, 23 at the bottom 6 or cover 8.

FIG. 2 shows the press marks 24, which appear from the outside in the holding region 19 when the end 5 of the cylinder pipe 1 is pushed into the groove-shaped recess 17 and are produced by means of a pressing tool (not shown here) acting in the radial direction at many points simultaneously on the end 5 of the cylinder pipe 1. This results in a uniform contact of the holding region 19 and a tight and sealed connection. In a similar manner (also not show here), in the region of the other end 7 of the cylinder pipe 1, the holding region 18 is pressured uniformly into the groove-shaped recess 16, performed here, of course, from the inside.

FIGS. 3 to 5 show the regions 25 of the ends, and each holding region 18, 19 of the non-deformed cylinder pipe. Each region 25 has a turned groove 26, which, in the deformed state (see FIG. 1) of the cylinder pipe 1, reaches over the related inner edge 27 (FIGS. 6 and 7) of each groove-shaped recess 16, 17.

As is evident from the shaping shown especially in FIGS. 4 and 5, the outer edge of turned groove 26, here sharp edge 29, claws itself during the compression operation into the material of the bottom 6 or cover 8. The clawing is particularly distinct when the two latter parts are made of a softer material such as aluminum. Thus, the result is a shape-locking connection, acting especially in the axial direction, between cylinder pipe 1 and bottom 6 or cover 8, so that the hydraulic cylinder can be loaded altogether with much higher operating pressures than was typical in the prior art for such connections.

Variations may be made to the concrete embodiment of the groove-shaped recess 16, shown as an example in FIGS. 4 to 7, its inner edge 27, turned groove 26, and its outer edge 29. These other embodiments of these elements are naturally also conceivable and possible within the framework of the invention. Thus, for example, the slope 30 on the left side of the groove-shaped recess 16 according to FIG. 7 serves to counteract the axial shortening of the cylinder pipe 1 during expansion through compression and thus to exclude play between the compressed parts.

By designing the turned groove 26, the shape-locking reach of the inner edge 27 of the groove-shaped recess 16 is improved in the deformed state of the cylinder pipe 1. Thus, a desired improvement in the connection between the cylinder pipe 1 and the bottom 6 or cover 8 in the axial direction is achieved.

Although the present invention has been described in connection with preferred embodiments, it will be appreciated by those skilled in the art that additions, modifications, substitutions and deletions not specifically described may be made without departing from the spirit and scope of the invention defined in the appended claims.

What is claimed is:

1. Hydraulic cylinder comprising a cylinder pipe having two ends, wherein one end is provided with a bottom and the other end is provided with a cover, the cover and bottom are each provided with a groove-shaped recess into which is engaged a holding region of a respective end of the cylinder pipe by a permanent deformation, each groove-shaped recess has a holding edge, and each holding region of the cylinder pipe has a turned groove which in the permanently deformed state of the cylinder pipe reaches over the respective edge of the respective groove-shaped recess.

2. Hydraulic cylinder according to claim 1, wherein said cylinder pipe has a longitudinal axis and the edge of each turned groove is oriented at an angle with respect to the longitudinal axis of the cylinder pipe.

3. Hydraulic cylinder according to claim 1, wherein each end of the cylinder pipe has several holding regions with turned recesses and the bottom and cover have several related groove-shaped recesses.

4. Hydraulic cylinder, according to claim 1, wherein the cylinder pipe is made of a relatively hard material and at least one of the bottom and cover is made of a relatively soft material.

5. Hydraulic cylinder, according to claim 1, wherein at least one of the bottom and the cover overlaps the related end of the cylinder pipe and the respective holding region has its turned recess on the outside to the cylinder pipe.

6. A hydraulic cylinder comprising a bottom part, a cover part, and a cylinder pipe extending therebetween and having a substantially constant first outer diameter along a length thereof, said cylinder pipe including a first end connected to said bottom part and an opposite second end connected to said cover part, said bottom part having a groove-shaped recess and said cover part having a groove-shaped recess, said first end including a first holding region where said first end is connected to said bottom part, said second end including a second holding region where said second end is connected to said cover part, said first holding region including a turned groove for cooperating with the respective groove-shaped recess of said bottom part, said second holding region including a turned groove for cooperating with the respective groove-shaped recess of said cover part, wherein to connect the cylinder pipe to at least one of said bottom part and said cover part, the holding region of the respective end of the cylinder pipe is engaged with the cooperating groove-shaped recess such that said turned groove overlaps said groove-shaped recess and said holding region is permanently deformed to define a second outer diameter of the cylinder pipe at said respective end which is different that said first outer diameter.

7. A hydraulic cylinder according to claim 6, wherein in the deformed state of the cylinder pipe the holding region of at least one end of said cylinder entirely overlaps at least a portion of the groove-shaped recess of the respective bottom part or cover part.

8. A hydraulic cylinder according to claim 6, wherein said cylinder pipe has a longitudinal axis and the edge of each turned groove is skewed angularly with respect to the longitudinal axis of the cylinder pipe.

9. A hydraulic cylinder according to claim 6, wherein each end of the cylinder pipe has more than one holding region with a turned groove and said bottom part and cover part each has more than one related groove-shaped recess.

10. A hydraulic cylinder according to claim 6, wherein said cylinder pipe comprises a relatively hard material and said at least one of said bottom part and cover part comprises a relatively soft material.

11. A hydraulic cylinder according to claim 10, wherein said cylinder pipe comprises steel and at least one of said bottom part and said cover part comprises aluminum.

12. A hydraulic cylinder according to claim 6, wherein said at least one of said bottom part and cover part fits over the related end of the cylinder pipe and overlaps the related end, and wherein the respective holding region of the related end has its turned groove on the external surface of the cylinder pipe, and wherein said related end is permanently deformed from the inside into the groove-shaped recess of said at least one of said bottom part and cover part.

13. A hydraulic cylinder according to claim 6, wherein said first end of the cylinder pipe has been permanently deformed to define an outer diameter at said first end which is smaller than said first outer diameter at said first end which is smaller than said first outer diameter and said second end of the cylinder pipe has an outer diameter which has been permanently deformed to define an outer diameter at said second end which is larger than said first outer diameter.

* * * * *